US011439964B2

(12) United States Patent
Sasso

(10) Patent No.: US 11,439,964 B2
(45) Date of Patent: Sep. 13, 2022

(54) CONTAINER FOR LIQUIDS

(71) Applicant: BLENDBOX LLC, Hohokus, NJ (US)

(72) Inventor: Adam Sasso, Hohokus, NJ (US)

(73) Assignee: BLENDBOX LLC, Hohokus, NJ (US)

( * ) Notice: Subject to any disclaimer, the term of this patent is extended or adjusted under 35 U.S.C. 154(b) by 226 days.

(21) Appl. No.: 16/717,416

(22) Filed: Dec. 17, 2019

(65) Prior Publication Data

US 2021/0178348 A1 Jun. 17, 2021

(51) Int. Cl.

| | |
|---|---|
| ***B01F 33/501*** | (2022.01) |
| ***B65D 5/02*** | (2006.01) |
| ***B65D 5/40*** | (2006.01) |
| ***B65D 5/54*** | (2006.01) |
| ***B65D 5/48*** | (2006.01) |
| ***B01F 25/421*** | (2022.01) |
| ***B01F 101/14*** | (2022.01) |
| ***B31B 50/00*** | (2017.01) |
| *B31B 50/74* | (2017.01) |
| *B31B 50/62* | (2017.01) |
| *B31B 50/20* | (2017.01) |
| *B31B 110/35* | (2017.01) |

(52) U.S. Cl.

CPC .... *B01F 33/50111* (2022.01); *B01F 25/4231* (2022.01); *B31B 50/0044* (2017.08); *B65D 5/029* (2013.01); *B65D 5/40* (2013.01); *B65D 5/48016* (2013.01); *B65D 5/541* (2013.01); *B01F 2101/14* (2022.01); *B31B 50/20* (2017.08); *B31B 50/624* (2017.08); *B31B 50/742* (2017.08); *B31B 2110/35* (2017.08)

(58) Field of Classification Search

CPC ..... B65D 5/029; B65D 5/40; B65D 5/541; B65D 5/48016; B65D 5/748; B65D 2231/00; B65D 47/263; B65D 5/48014; B65D 5/60; B65D 77/06; B01F 13/0022; B01F 5/0606; B01F 2215/0022; B01F 33/50111; B67D 3/00

USPC ..... 366/130; 222/105, 81, 1, 129, 143; 220/833, 825, 326; 206/219; 229/125.04, 125.09

See application file for complete search history.

(56) References Cited

U.S. PATENT DOCUMENTS 2,585,538 A * 2/1952 Daniels ..... B65D 5/746 222/416
2,751,119 A * 6/1956 Manning, Sr. ..... B67B 7/26 222/548
5,067,613 A * 11/1991 Bryan ..... B65D 5/068 229/216
5,108,029 A * 4/1992 Abrams ..... B65D 5/746 220/837
5,564,622 A * 10/1996 Wald ..... B67B 7/26 229/125.42

(Continued)

*Primary Examiner* — Christopher R Demeree
(74) *Attorney, Agent, or Firm* — Greer Burns & Crain Ltd.

(57) ABSTRACT

A container for liquids has a top, a bottom and a mid-section. A plurality of side panels forming the mid-section, and a plurality of top panels enclose the top of the container. One of the top panels has an openable seal for removing liquid from the container when the seal is broken. A plurality of bottom flaps are provided for closing the bottom of the container, and a baffle is secured inside of the container. The baffle has at least one opening for mixing liquid contained in the container when the container is closed and shaken.

3 Claims, 7 Drawing Sheets

(56) References Cited

U.S. PATENT DOCUMENTS

| | | | | |
|---|---|---|---|---|
| 7,934,637 | B2 * | 5/2011 | Kaneko | B65D 5/746<br>229/125.42 |
| 8,714,380 | B2 * | 5/2014 | Casale | B65D 5/065<br>215/297 |

* cited by examiner

CONTAINER FOR LIQUIDS

This invention relates to containers, and more particularly, to liquid containers having internal baffles.

BACKGROUND OF THE INVENTION

A variety of drinks are available for consumer consumption after exercising, for example. However, such drinks sometimes have particulate matter that settles to the bottom of the container. Shaking the container before use to mix the particulates is helpful, but does not always adequately suspend the particulates. Thus, there is a need for containers for liquids having more thorough mixing capability.

Accordingly, one object of this invention is to provide new and improved containers for liquids.

Another object is to provide new and improved liquid containers with internal baffles for agitation of particulates in liquid in the containers.

SUMMARY OF THE INVENTION

In keeping with one aspect of this invention, a container for liquids has a top, a bottom and a mid-section, a plurality of side panels forming the mid-section, a selected side panel having a side panel flap, and a plurality of top panels enclosing the top of the container. One of the top panels has an openable seal for removing liquid from the container when the seal is broken. A plurality of bottom flaps are provided for closing the bottom of the container, and a baffle is secured inside of the container. The baffle has at least one opening for mixing liquid contained in the container when the container is closed and shaken.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
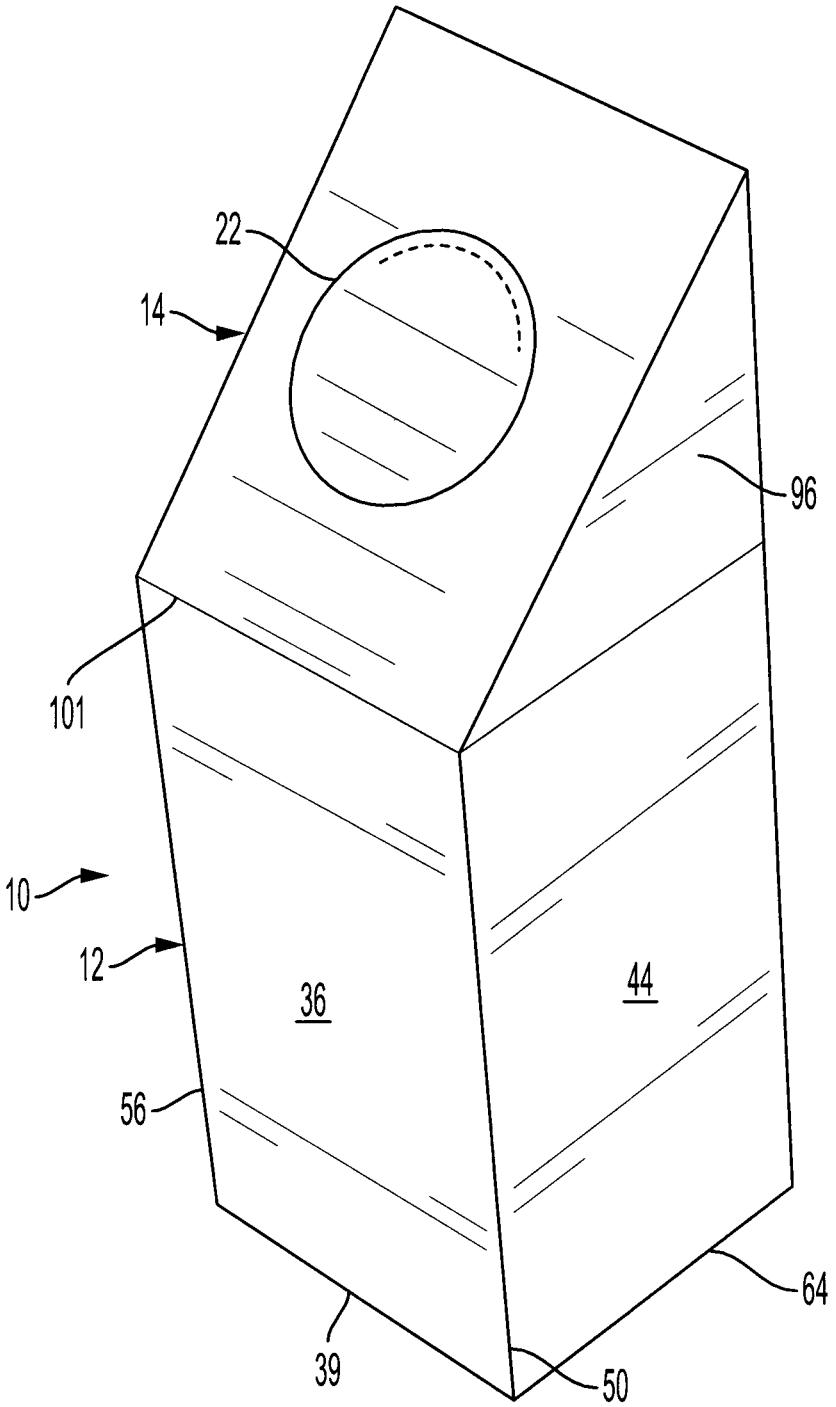
FIG. 1 is a perspective view of one embodiment of a container according to the present invention.
Figure 2A:
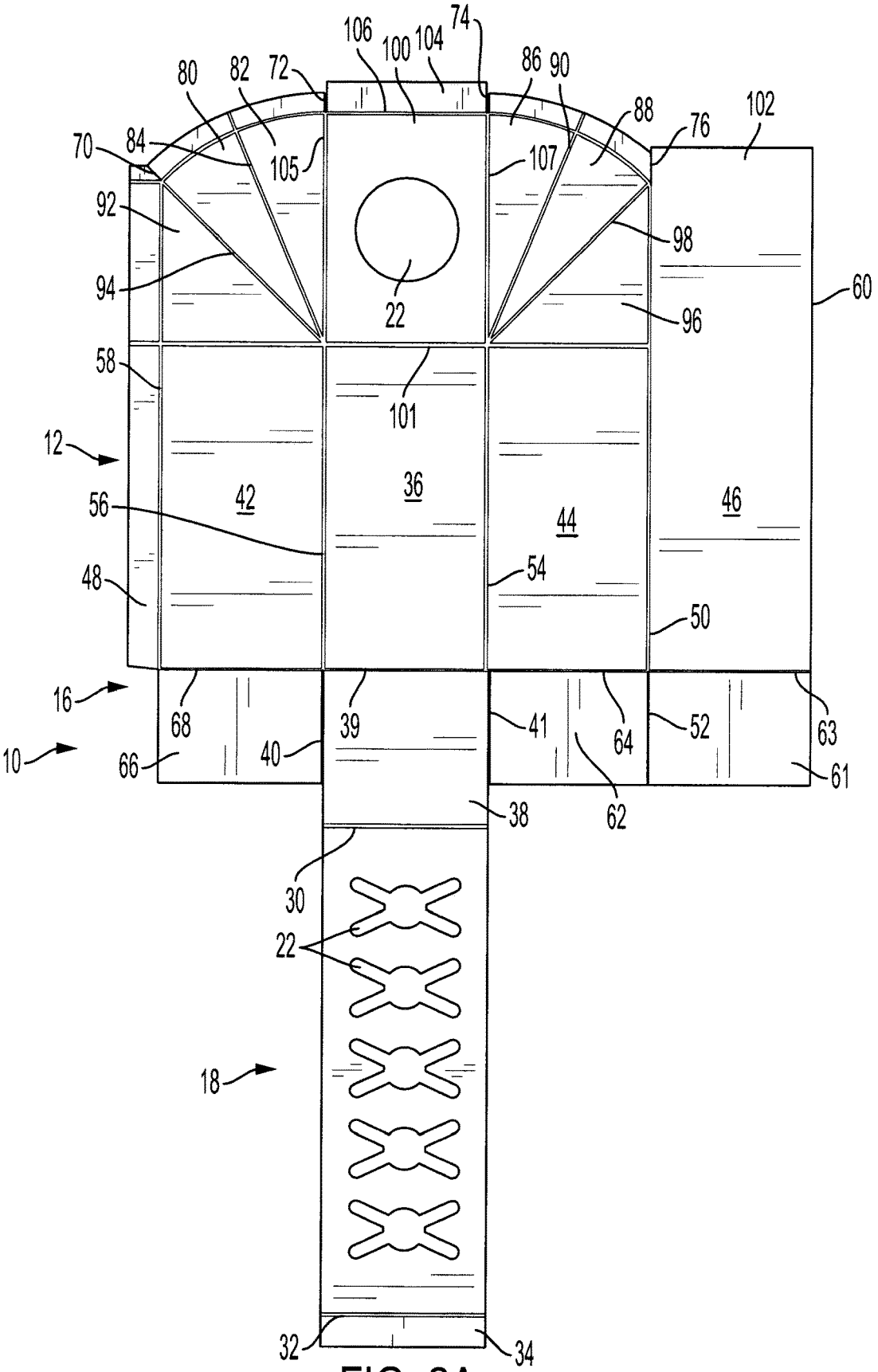
FIG. 2A is plan view of a single piece of coated paper used to make the container of FIG. 1.
Figure 2B:
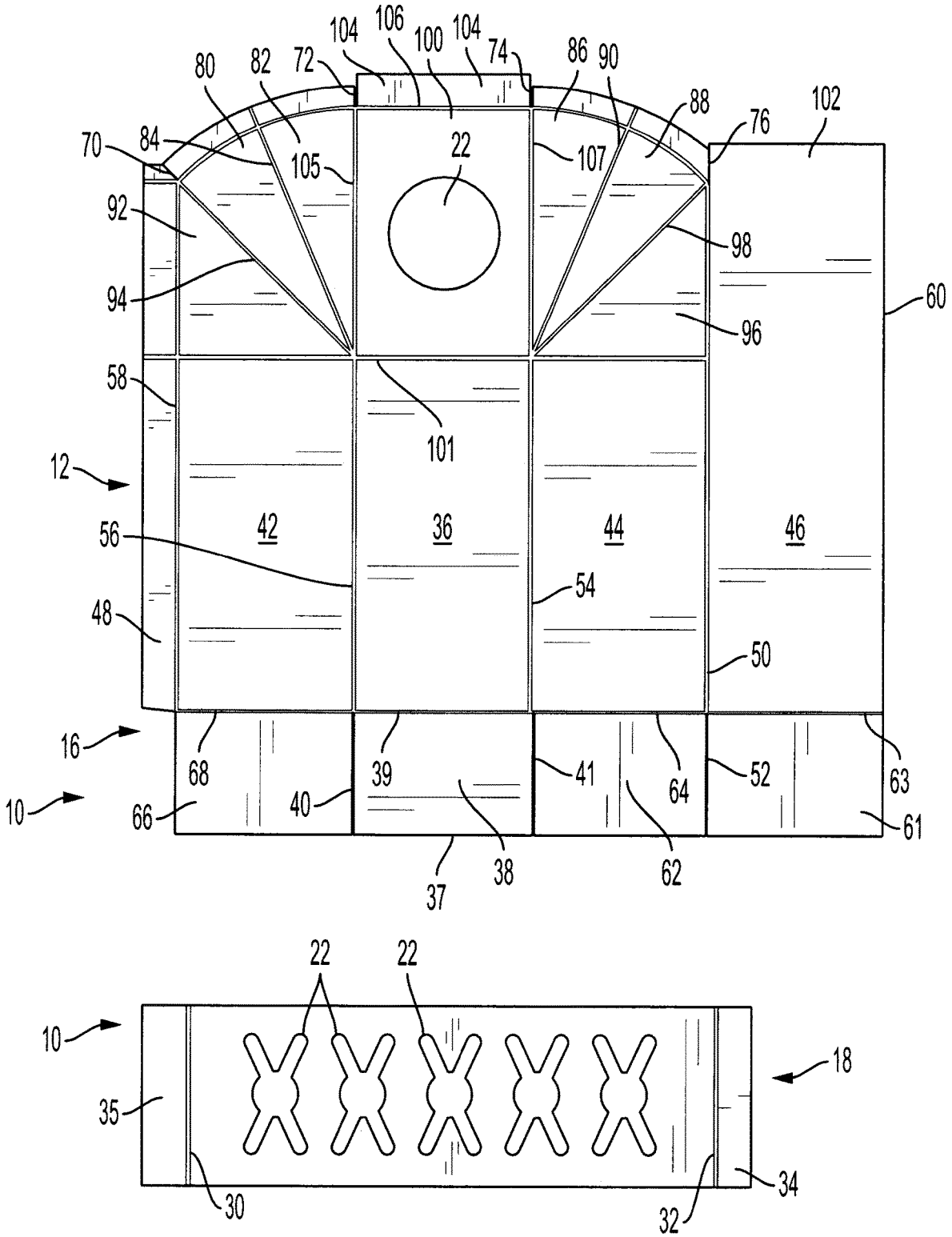
FIG. 2B is a plan view of two pieces of coated paper used to make the container of FIG. 1.

As seen in FIGS. 1, 2A and 2B, a container 10 has a midsection 12, a top section 14 and a bottom section 16. The container can be made of coated paper.

A baffle 18 having openings 20 extends from the bottom section 16 in a one-piece embodiment shown in FIG. 2A. The top section 14 has an opening 22 that is sealed when the container 10 is filled with liquid, and broken along the perforated line in FIG. 1, for example, with a straw or other device to remove the liquid from the container 10. A typical liquid can include particulate matter such as fruit pulp.

The container 10 can be made by cutting, folding and gluing the single piece of paper seen in FIG. 2A, or using two pieces of material, seen in FIG. 2B. Dual lines in FIGS. 2A and 2B indicate creases, and single lines in the interior space of the material indicate cut lines.

Figure 3:
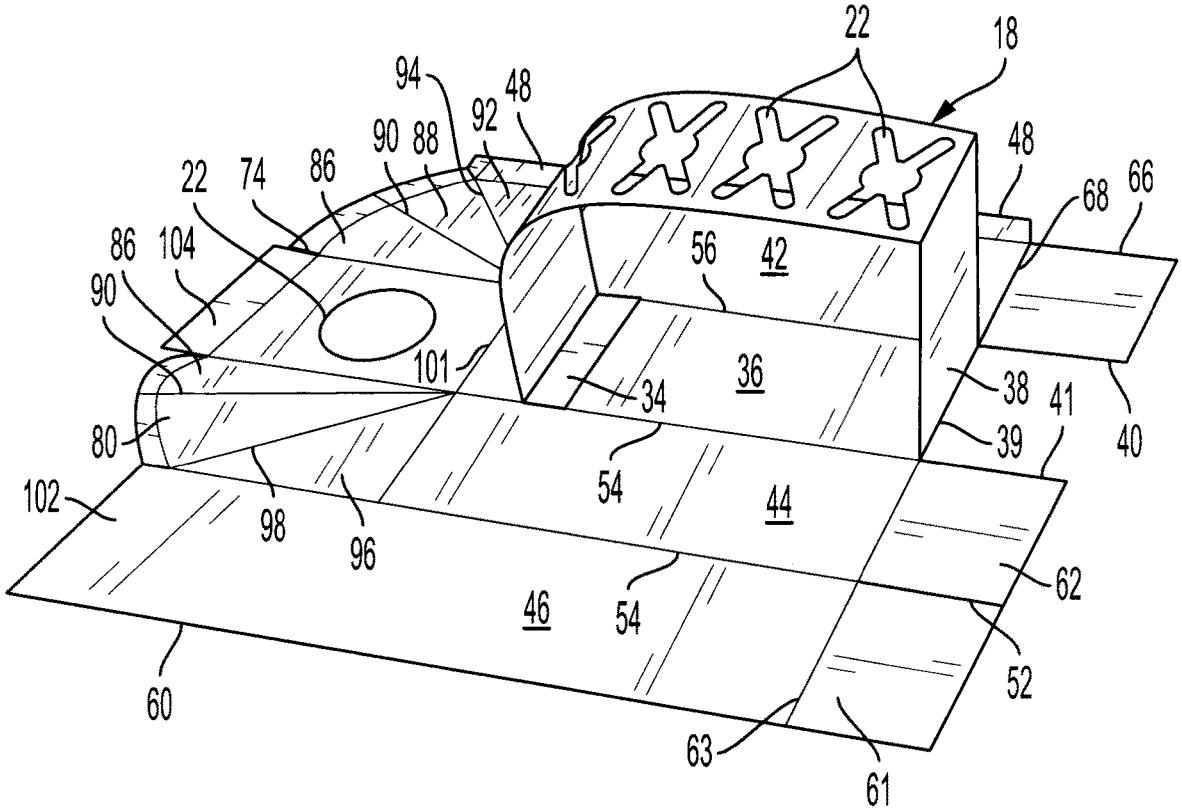
FIG. 3 is a perspective view showing the flap of a baffle adhered to a side panel.

The container 10 is assembled by folding the baffle 18 at creases 30 and 32. A flap 34 is then adhered to a side panel 36, as seen in FIG. 3. The baffle 18 is folded after cutting a bottom panel 38 along cut lines 40, 41, and folding the panel 38 at a crease 39. In FIG. 2B, a flap 35 is adhered to the side panel 36 near a fold line 37.

Referring again to FIGS. 2A and 2B, the midsection 12 includes side panels 42, 44, and 46 in addition to the panel 36. The side panel 46 also forms part of the upper section 14. A side panel flap 48 provided for adhesive, as will be seen.

Assembly can begin by cutting along lines 40, 41, 52, 70, 72, 74 and 76. The midsection 12 is assembled by folding the panel 46 and panel 44 at a crease 50. The panels 44 and 36 are then folded at a crease 54, and the panels 36 and 42 are folded at a crease 56. The panel 42 and a flap 48 are folded at a crease 58, and the flap 48 is adhered across an exterior edge 60 of the panel 46. This forms the midsection 12 in the manner shown in FIG. 4.

Figure 4:
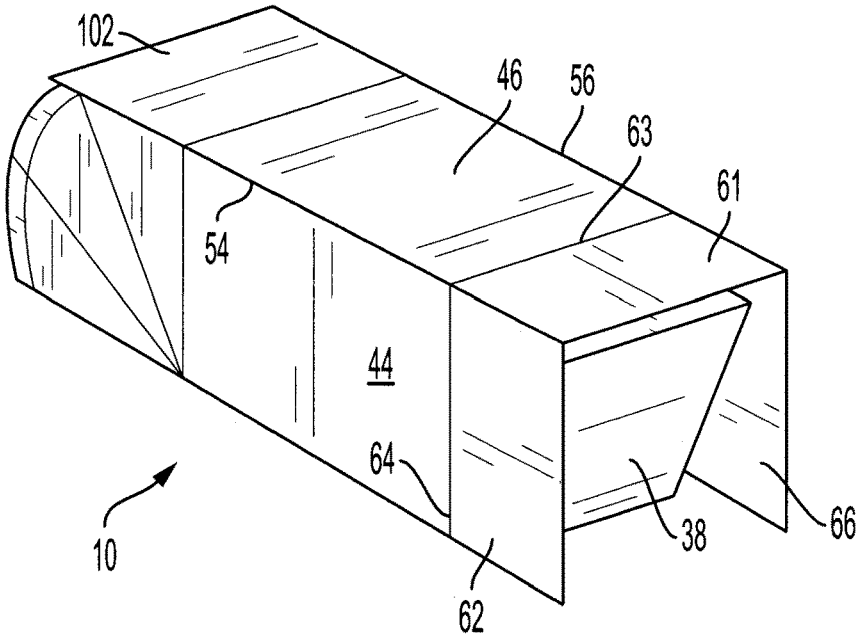
FIG. 4 is a perspective view of the side panels folded and adhered to form a mid-section of the container of FIG. 1.
Figure 5:
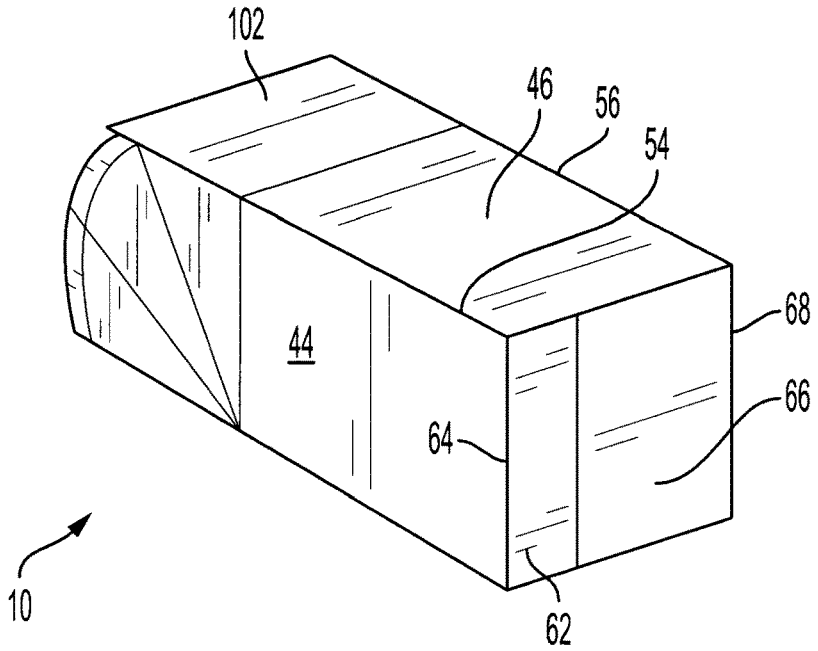
FIG. 5 is a perspective view showing the bottom panels folded and adhered to form a bottom of the container of FIG. 1.
Figure 6:
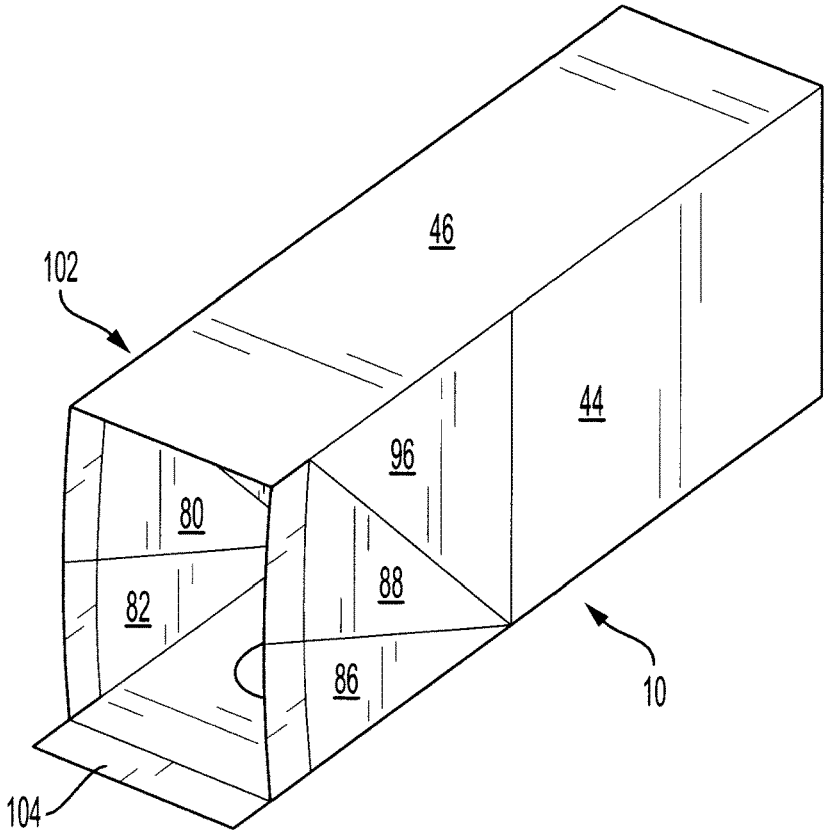
FIG. 6 is a perspective view showing the top panels before folding and adhered to form a top of the container of FIG. 1.
Figure 7:
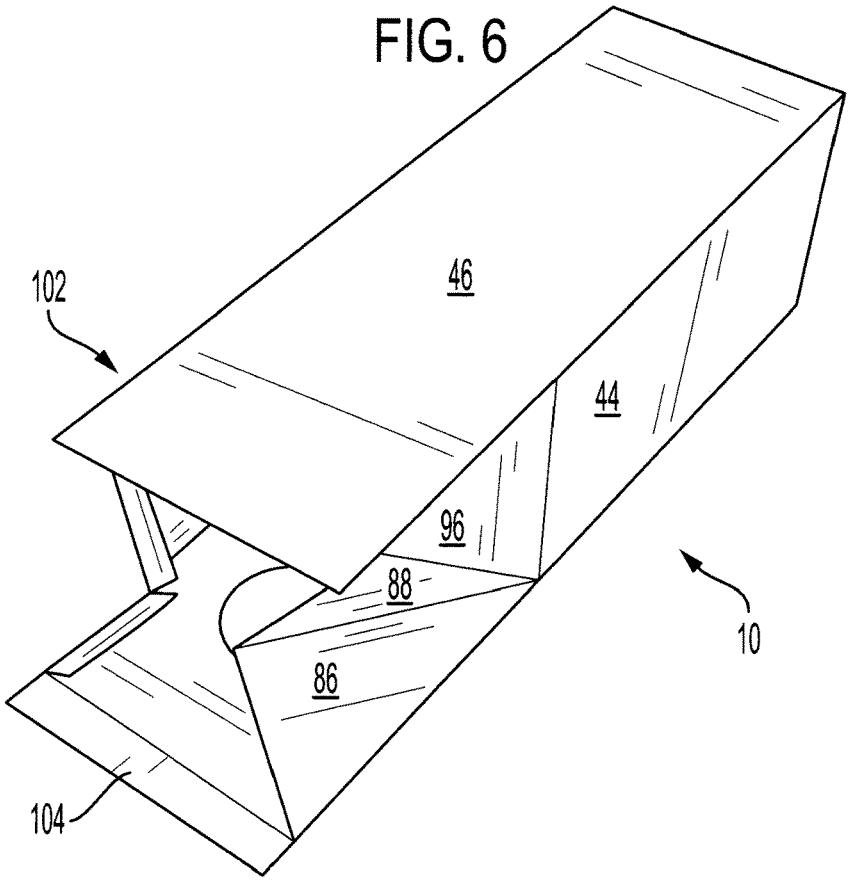
FIG. 7 is a perspective view showing the top panels partially folded and ready to be adhered.

The bottom section 16 is then assembled by folding a bottom panel 61 at a crease 64, folding a bottom panel 62 at a crease line 64 and folding a bottom panel 66 at a crease line 68, as seen in FIG. 4. The panels 62 and 66 are then adhered to each other outside of the panel 38 and the panel 61 to form the bottom section 16, as seen in FIG. 5.

Figure 8:
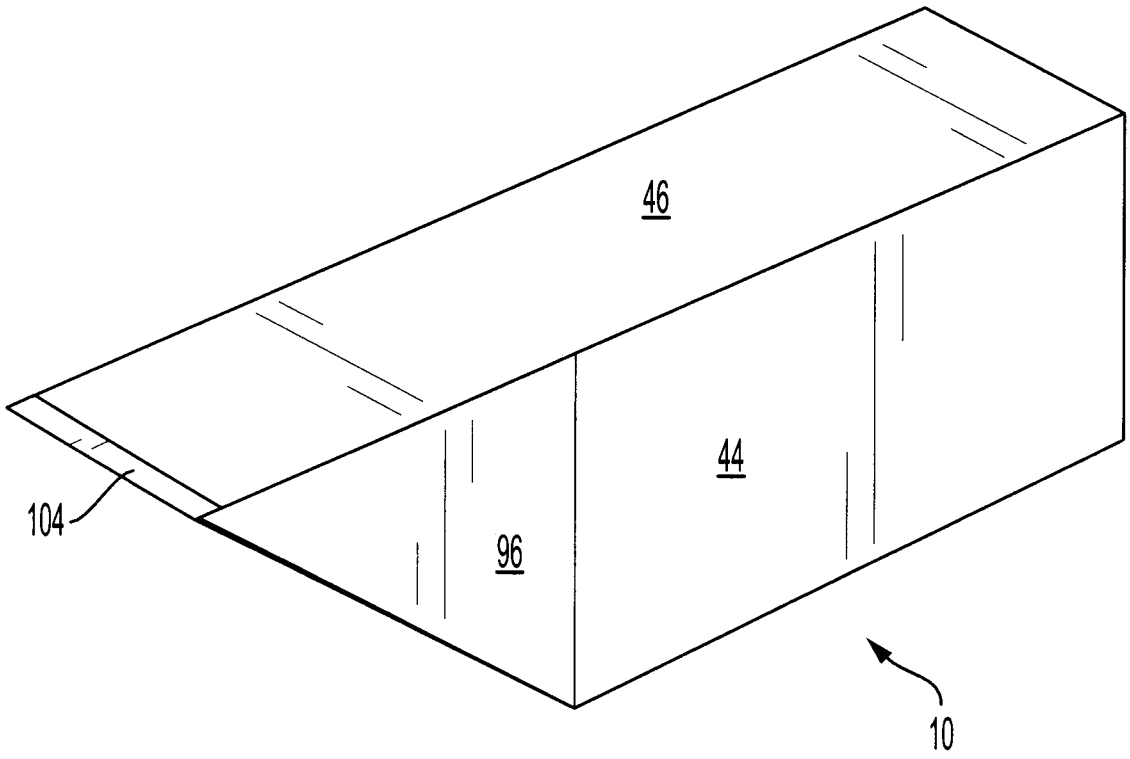
FIG. 8 is a perspective view showing the container of FIG. 1 fully assembled.

To form the top portion 14, panels 80, 82 are folded along crease 84, and panels 86 and 88 are folded along crease 90. The panel 80 and a panel 92 are folded along a crease 94, and the panel 88 and a panel 96 are folded along a crease 98. The panels 100 and 82 are folded along crease 105, and panels 100 and 86 are folded along a crease 107. The panels 80, 82, 86 and 88 are folded so that a panel 100 folds at a crease 101 towards the top end 102 of the panel 46. A top section flap 104 is folded in a crease 106 and adhered to the top 102. The flaps 80 and 82 are adhered to each other on one side of the top portion and the flaps 86 and 88 are adhered to each other on the other side of the top portion 14, as seen in FIG. 8, and assembly of the container 10 is completed.

Liquid can be easily placed in the container 10 before the top section 14 is assembled. The liquid is removed by piercing an appropriate material such as a straw in the opening 22 to remove the liquid.

In use, the liquid in the container 10 can be thoroughly agitated and mixed before opening the container 10 by shaking the container. In the process the liquid and in some cases particulate matter is shaken through the openings 20 in the baffle 18.

While the principles of the invention have been described above in connection with specific apparatus and applications, it is to be understood that this description is made only by way of example and not as a limitation on the scope of the invention.

What is claimed is:

1. A container for liquids comprising:

a top, a bottom, a mid-section, and a baffle foldably attached at the bottom of the container and extended into the mid-section, the baffle having at least one opening for mixing liquid contained in the container when the container is closed and shaken.

2. A container for liquids, the container having a top, a bottom and a mid-section, comprising:

a plurality of side panels forming the mid-section, a selected side panel having a side panel flap, a plurality of top panels enclosing the top of the container, one of the top panels having an openable seal for removing liquid from the container when the seal is broken, a plurality of bottom flaps for closing the bottom of the container, and a baffle foldably attached at the bottom of the container and extending into the mid-section, the baffle having at least one opening for mixing liquid contained in the container when the container is closed and shaken.

3. A container for liquids comprising one piece of coated paper, the one piece of coated paper being folded to form a top, a bottom, a mid-section, and a baffle foldably attached at the bottom of the container and extending into the mid-section, the baffle having at least one opening for mixing liquid contained in the container when the container is closed and shaken.

* * * * *